United States Patent [19]

Korsen

[11] 4,426,650

[45] Jan. 17, 1984

[54] TAPE ERECTABLE ANTENNA MAST

[75] Inventor: Iverson Korsen, Dresher, Pa.

[73] Assignee: American Electronic Laboratories, Inc., Lansdale, Pa.

[21] Appl. No.: 35,888

[22] Filed: May 4, 1979

[51] Int. Cl.[3] ..... H01Q 1/10

[52] U.S. Cl. ..... 343/903; 343/889; 343/883

[58] Field of Search ..... 343/901, 903, 883, 889

[56] References Cited

U.S. PATENT DOCUMENTS 2,781,668 2/1957 Berta ..... 343/903

3,893,125 7/1975 De Bellomayre ..... 343/903

FOREIGN PATENT DOCUMENTS 134724 3/1960 U.S.S.R. ..... 343/883

*Primary Examiner*—David K. Moore

*Attorney, Agent, or Firm*—Seidel, Gonda & Goldhammer

[57] ABSTRACT

Telescoping tubes capable of being extended for use as a mast are extendable or retractable by way of a tape having one end connected to the smallest tube and its other end contained in a spool. A tape guide is provided in the tube having the largest diameter. The tape guide is rectangular in section. A pair of guide rollers are provided adjacent the tape guide. Each guide roller is in rolling contact with a side edge of the tape at a location between the tape guide and means for winding or unwinding the tape.

10 Claims, 4 Drawing Figures

FIG. 1
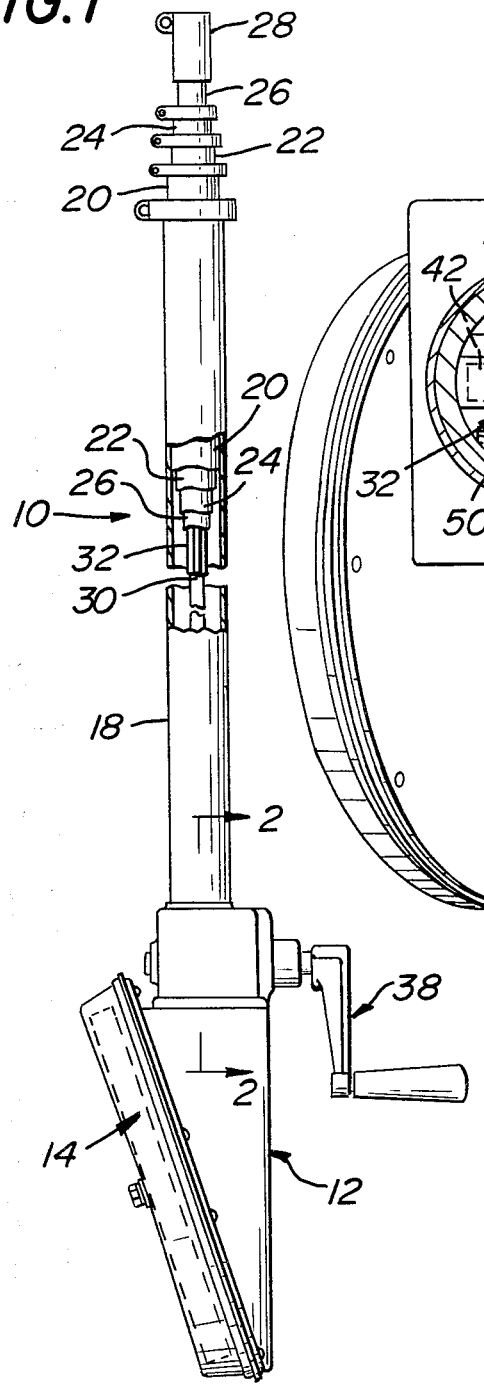
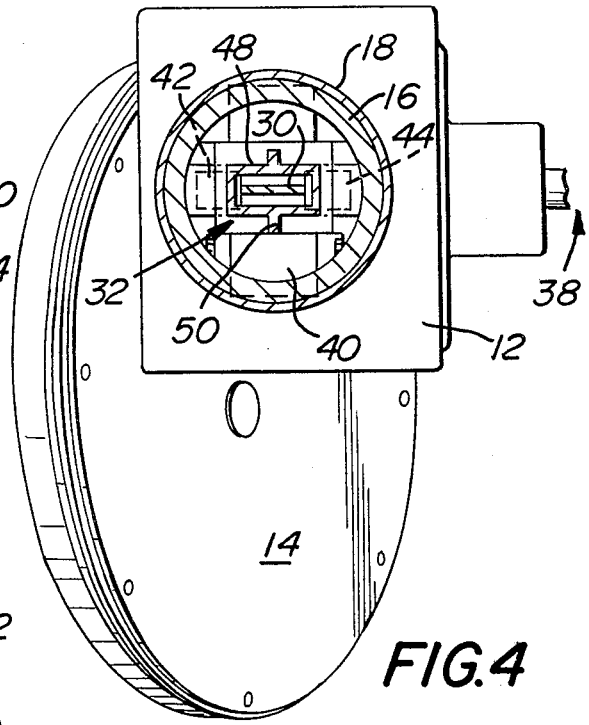
FIG. 4

TAPE ERECTABLE ANTENNA MAST

BACKGROUND

Tape erectable antenna masts have been utilized heretofore but are of the light duty type. Masts of the type utilized heretofore for light duty were not adaptable for use with medium or heavy duty since the tape would constantly buckle and bind thereby impairing the operation of the mast. The present invention is directed to a solution of the problem of how to make a medium to heavy duty tape erectable mast wherein the tape does not buckle or bind in a manner which impairs operation.

SUMMARY OF THE INVENTION

The tape erectable mast of the present invention includes a mast bottom which has a spool of semi-flexible tape. A plurality of telescoping tubes are coupled to each other with the tube of the largest diameter being coupled to said mast bottom, tape from the spool extends through said tubes and is connected to the tube with the smallest diameter. A tape guide is provided in the tube with the largest diameter.

A means is provided in contact with the tape between the spool and the tape guide for unwinding the tape and extending the mast. The tape guide is rectangular in section. A pair of guide rollers are provided. Each guide roller is in rolling contact with a discrete side edge of the mast at a location between the location of the tape guide and the tape unwinding means.

It is an object of the present invention to provide a tape erectable mast of the medium to heavy duty type wherein the tape does not buckle or bind so as to impair operation.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is an elevation view, partly in section, of the mast in its collapsed condition.

FIG. 4 is a sectional view taken along the line 4—4 in FIG. 3.

Figure 2:
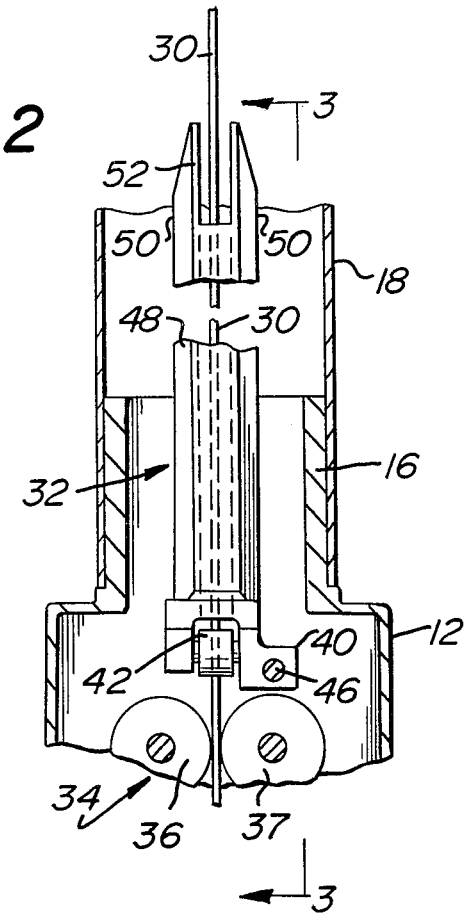
FIG. 2 is a sectional view taken along the line 2—2 in FIG. 1.

Referring to the drawings in detail, wherein like numerals indicate like elements, there is shown in FIG. 1 a mast in accordance with the present invention designated generally as 10. The mast 10 includes a mast bottom or support 12 to which is connected a tape housing 14. A tape spool shown in phantom in FIG. 1 is rotatably disposed within the tape housing 14. The tape housing 14 is angularly disposed with respect to the extensable components of the mast as will be apparent in FIG. 1.

Referring to FIG. 2, the mast bottom 12 has a tubular boss 16. A tube 18 has one end force-fit to the outer periphery of boss 16. Tube 18 may be fixedly secured to boss 16 in any suitable manner. The mast includes a plurality of telescoping tubes. Tube 18 is the largest diameter tube.

A tube 20 is telescoped within the tube 18. A tube 22 is telescoped within tube 20. A tube 24 is telescoped within tube 22. A tube 26 is telescoped within tube 24. Each of the tubes, except for tube 18, has a flange which contacts and extends the next adjacent tube in a manner which is known to those skilled in the art and not described or illustrated herein. Tube 26 terminates in an end cap. The peripheral flange on each of the tubes may have hooks to receive guy wires and/or other antenna structure.

The spool within housing 14 contains a semi-flexible metal tape 30. A free end of the tape 30 extends upwardly through the tubes 18–26 and is fixedly secured to the cap 28. As the tape 30 is moved upwardly in FIG. 1, the mast 10 is extended. As the tape 30 moves downwardly in FIG. 1, the mast 10 is collapsed.

Figure 3:
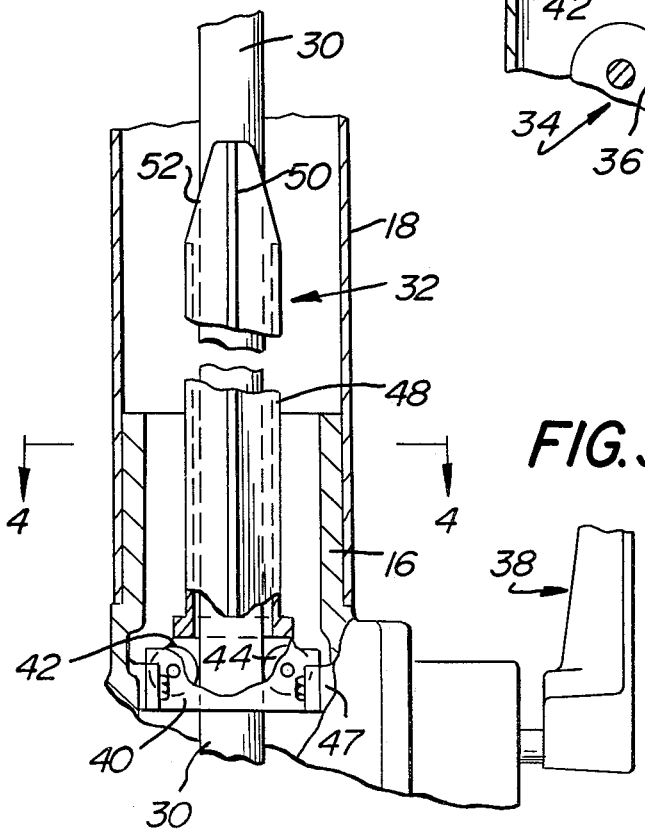
FIG. 3 is a sectional view taken along the line 3—3 in FIG. 2.

Referring to FIGS. 2–4, the tape 30 is provided with a tape guide 32 above a tape driver 34. The tape driver 34 includes a pair of friction rollers 36, 37 mounted on parallel axles. Each of the axles have meshing gears so that one of the rollers drives the other. One of the axles is connected to a handle 38 which may be a manually operable handle or an electrically driven handle for driving the rollers 36, 37.

The tape guide 32 includes a base 40 above the elevation of the rollers 36, 37. The base 40 rotatably supports guide rollers 42, 44. Each of the rollers 42, 44 is in rolling engagement with a side edge of the tape 30. The base 40 is pivotably supported within the boss 16 by pin 46 whereby the tape guide 32 is self-aligning with respect to the tape 30.

The tape guide 32 includes an upstanding guide tube 48 mounted on the base 40. Tube 48 preferably has a height approximately equal to the height of tube 18. The tube 48 is rectangular in cross-section as shown more clearly in FIG. 4 with oppositely disposed reinforcement ribs 50. The upper end of the tube 48 is tapered on opposite sides so as to guide tube section 26 during its descent to its collapsed position. It will be noted that the guide rollers 42, 44 move with the tape guide 32. The side faces of the tube 48 which are parallel to the side faces of the tape 30 are spaced therefrom so as to accommodate some slight waviness in the tape 30. In the event that there is a waviness in the tape 30, it will be noted that the length of the rollers 42, 44 is substantially greater than the space between the side faces of tube 48 so as to assure that contact will be maintained between said rollers 42, 44 and the tape 30.

The cap 28 may be provided with conventional sockets or other mounting studs for receiving antennas. The mast bottom 12 may be mounted on a post, on a vehicle, or any other suitable base. The mast 10 is designed to handle loads which are in excess of about 25 to 30 pounds. I have found that it is not possible to handle such loads in the absence of the tape guide 32.

The present invention may be embodied in other specific forms without departing from the spirit or essential atrributes thereof and, accordingly, reference should be made to the appended claims, rather than to the foregoing specification, as indicating the scope of the invention.

I claim:

1. A tape erectable mast comprising a mast bottom containing a spool of semi-flexible tape, a plurality of telescoping tubes, said tape extending through said tubes and being connected to the tube with the smallest diameter, a tape guide extending into and generally along the axis of said tubes, means in contact with the tape between the spool and said tape guide for winding and unwinding the tape to thereby extend or retract the mast, said tape guide being rectangular in section, a pair of guide rollers, each guide roller being in rolling contact with a discrete side edge of the tape at a location between said tape guide and said means for winding and unwinding the tape.

2. A mast in accordance with claim 1 wherein said tape guide includes a tube rectangular in section through which said tape extends, said rectangular tube and said guide rollers being mounted on a common base, the shortest distance between the peripheries of said guide rollers being less than the longest dimension of said rectangular tube on the inner periphery thereof, said guide rollers being aligned with the interior of said rectangular tube.

3. A mast in accordance with claim 1 wherein said guide rollers and tape guide are movably supported by said mast bottom so as to be self-accommodating with respect to the tape.

4. A mast in accordance with claim 3 wherein said tape guide includes a tube which is rectangular in cross-section and extends upwardly into the lower end of said telescoping tube having the largest diameter.

5. A mast in accordance with claim 1 wherein said tape guide is pivotably mounted for limited pivotable movement about an axis parallel to a major face of the tape.

6. A mast in accordance with claim 5 wherein said guide rollers rotate about axes which are perpendicular to said lastmentioned axis and to the major faces of said tape.

7. A mast in accordance with claim 1 wherein said tape guide is tapered at its upper end and has at least one reinforcement rib disposed longitudinally thereon.

8. A tape erectable mast comprising a support member, a spool of semi-flexible tape, a plurality of telescoping tubes extending upwardly from said support member, said tape extending from said spool unwardly through said tubes and being connected to the tube with the smallest diameter, means in contact with the tape between the spool and the tube with the largest diameter for unwinding the tape from the spool and extending said telescoping tubes upwardly, a tape guide above the elevation of said unwinding means, said tape guide having a portion which is rectangular in cross-section and through which said tape extends, said tape guide including a pair of guide rollers, each guide roller being in rolling contact with a side edge of the tape, means supporting said tape guide and said guide rollers for limited movement relative to the tube with the largest diameter in a direction generally transverse with respect to the diameter of said tube with the largest diameter to facilitate self-alignment of the tape guide with respect to the tape.

9. A mast in accordance with claim 8 wherein said lastmentioned means includes a pin pivotably supporting said tape guide and guide rollers about an axis parallel to a major face of the tape and spaced from the longitudinal axis of said tube with the largest diameter.

10. A telescoping mast erecting apparatus comprising a mast bottom containing a spool of semi-flexible metal tape, said tape having a width substantially greater than its thickness, a plurality of telescoped tubes constituting a mast, said tape extending through said tubes and being connected to the tube with the smallest diameter, means in contact with the tape for winding and unwinding the tape to thereby retract or extend the mast defined by said tubes, each tube having means thereon for securement to a guy wire or the like, guide means for enabling said mast to handle loads in excess of about 25 pounds, said guide means including a tape guide open at opposite ends and being rectangular in section, said tape guide extending into and generally along the axis of said tubes, said tape extending through said tape guide, said tape guide being movably supported by the mast bottom so as to be self-accomodating with respect to the tape extending therethrough, and said tape guide being tapered at its upper end so that external transverse dimensions of said tape guide at its upper end are less than the width of said tape.

* * * * *